US007591665B2

(12) United States Patent
Nakamura

(10) Patent No.: US 7,591,665 B2
(45) Date of Patent: Sep. 22, 2009

(54) CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/107,259

(22) Filed: Apr. 22, 2008

(65) Prior Publication Data

US 2008/0261438 A1 Oct. 23, 2008

(30) Foreign Application Priority Data

| | | |
|---|---|---|
| Apr. 23, 2007 | (JP) | 2007-112489 |
| Apr. 26, 2007 | (JP) | 2007-116327 |
| Aug. 10, 2007 | (JP) | 2007-209454 |
| Apr. 14, 2008 | (EP) | 08007320 |

(51) Int. Cl.
*H01R 13/64* (2006.01)

(52) U.S. Cl. ..... 439/374; 439/752

(58) Field of Classification Search ..... 439/374, 439/455, 459, 460

See application file for complete search history.

(56) References Cited

U.S. PATENT DOCUMENTS

| | | | | |
|---|---|---|---|---|
| 6,506,072 | B2 | 1/2003 | Nimura | |
| 7,025,621 | B2 * | 4/2006 | Mossner et al. | 439/395 |
| 7,234,962 | B1 * | 6/2007 | Lin | 439/441 |
| 7,367,837 | B2 * | 5/2008 | Pabst | 439/460 |

* cited by examiner

*Primary Examiner*—Tho D Ta
*Assistant Examiner*—Travis Chambers
(74) *Attorney, Agent, or Firm*—Gerald E. Hespos; Anthony J. Casella

(57) ABSTRACT

A wire holder (50), when correctly mounted in a housing (10), bites in insulation coatings (33*b*) of wires (33), whereby the wires (33) are so held as not to move. The wire holder (50) mounted in a direction intersecting the inserting direction of terminal fittings (30) and the extending direction of the wires (33) bite in the insulation coatings (33*b*) of the wires (33). Therefore, it is not necessary to bend the wires (33) and a layout space for the wires (33) can be smaller.

5 Claims, 11 Drawing Sheets

CONNECTOR

BACKGROUND OF THE INVENTION

1. Field of the Invention

The invention relates to a connector.

2. Description of the Related Art

U.S. Pat. No. 6,506,072 discloses a connector with a housing, terminal fittings that are inserted into the housing and a strain relief portion for restricting movements of wires fixed to the terminal fittings and drawn out from the housing. More particularly, the strain relief portion is a wire holder that is mounted on the housing from behind to restricting movement of the wires. Thus, the wires are squeezed between the wire holder and the housing to provide strain relief.

A wire layout path in the strain relief portion is bent in the above-described connector. Thus, a large layout space is necessary, resulting in a problem of enlarging the entire connector.

The present invention was developed in view of the above situation and an object thereof is to achieve miniaturization.

SUMMARY OF THE INVENTION

The invention relates to a connector that comprises a housing that can receive at least one terminal fitting that can be inserted into the housing along a inserting direction. A wire is fixed to a rear end of the terminal fitting and extends rearwardly therefrom. At least one wire holder is mounted into the housing in a direction intersecting the inserting direction of the terminal fitting. The wire holder bites in the insulation coating of the wire in a mounted state in the housing to substantially prevent movements of the wire.

The wire holder is mounted in a direction intersecting the extending direction of the wire. Thus, it is not necessary to bend the wire and a layout space for the wire can be smaller.

The terminal fitting preferably is long and narrow in forward and backward directions and preferably is inserted into the housing from behind. The wire holder preferably is mounted to a rear end portion of the housing.

The wire holder preferably can be locked selectively at a release position where the wire holder is separated from the wire and at a hold position where the wire holder is mounted correctly in the housing to prevent the movements of the wire. Thus, the wire holder can be mounted to the housing beforehand and operational efficiency is good.

The connector further preferably comprises a mounted-state detector for detecting the mounted state of the wire holder and/or for detecting whether the connector is properly connected with a mating connector.

The mounted-state detector preferably is a part separate from the wire holder and is movable with respect to the housing. The mounted-state detector preferably has an interfering portion that interferes with the wire holder when the wire holder is at a release position to prevent a movement of the mounted-state detector to a detection position. However, the mounted-state detector can move to the detection position when the wire holding member is at a hold position. Thus, the mounted state of the wire holder can be detected reliably based on whether the mounted-state detector can be moved to the detecting position.

The mounted-state detector preferably has a connection detector for permitting the mounted-state detector to move to the detection position when the connector is connected properly with a mating connector while preventing movement of the mounted-state detector to the detection position if the connector is left partly connected or is connected improperly with the mating connector. Thus, the number of parts can be reduced as compared to the case where a connection detecting means is provided in addition to the mounted-state detector.

The mounted-state detector preferably is formed with at least one cover for at least partly covering the wire holder from an outer side. Thus, external matter is unlikely to interfere with the wire holder.

The wire holder preferably has at least one pressable portion for contacting the mounted-state detector when the mounted-state detector is moved to and/or located at the detecting position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
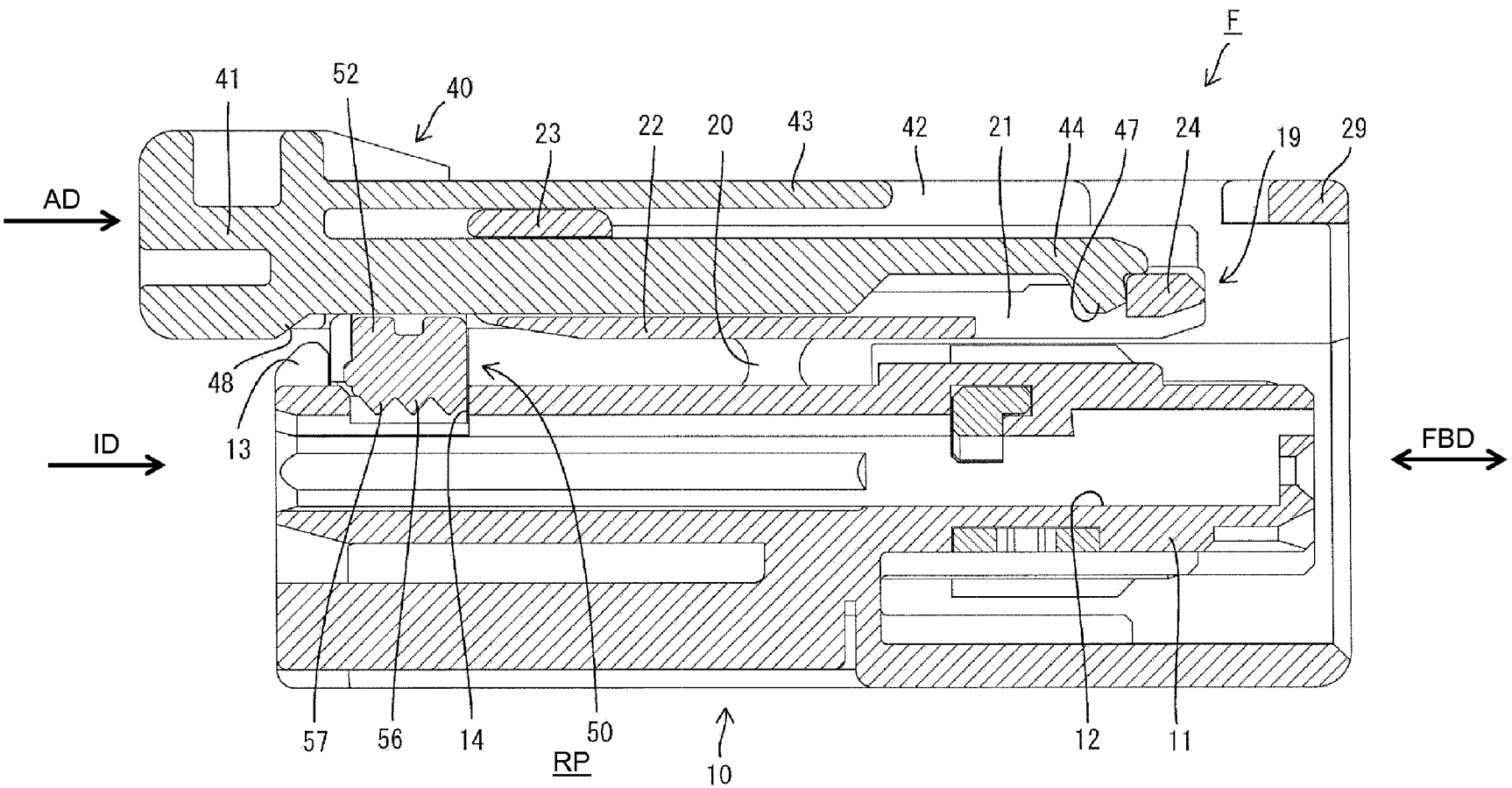
FIG. 1 is a longitudinal section showing a state where a wire holding member is at a release position in one embodiment.
Figure 2:
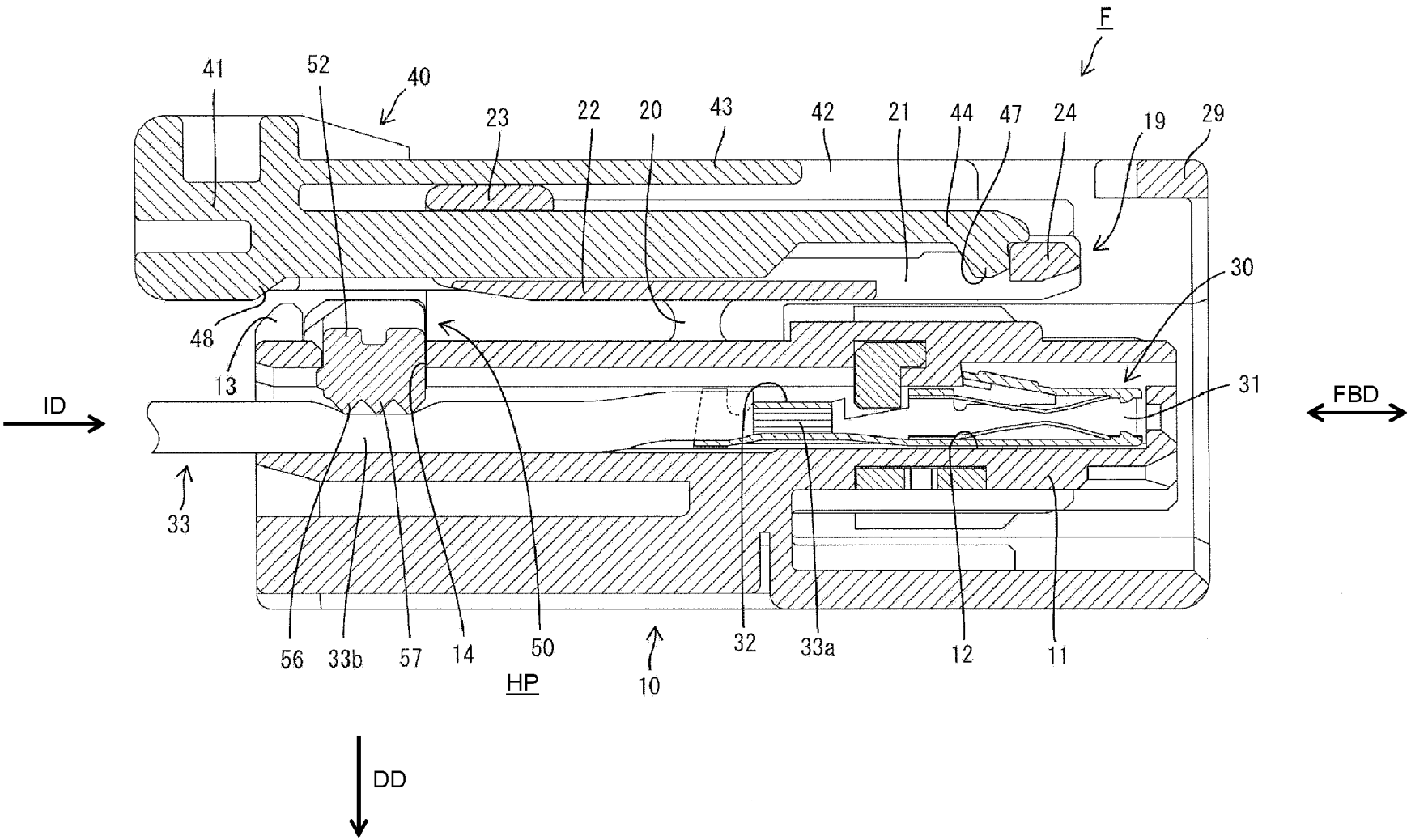
FIG. 2 is a longitudinal section showing a state where the wire holding member moved to a hold position is preventing movements of wires.
Figure 3:
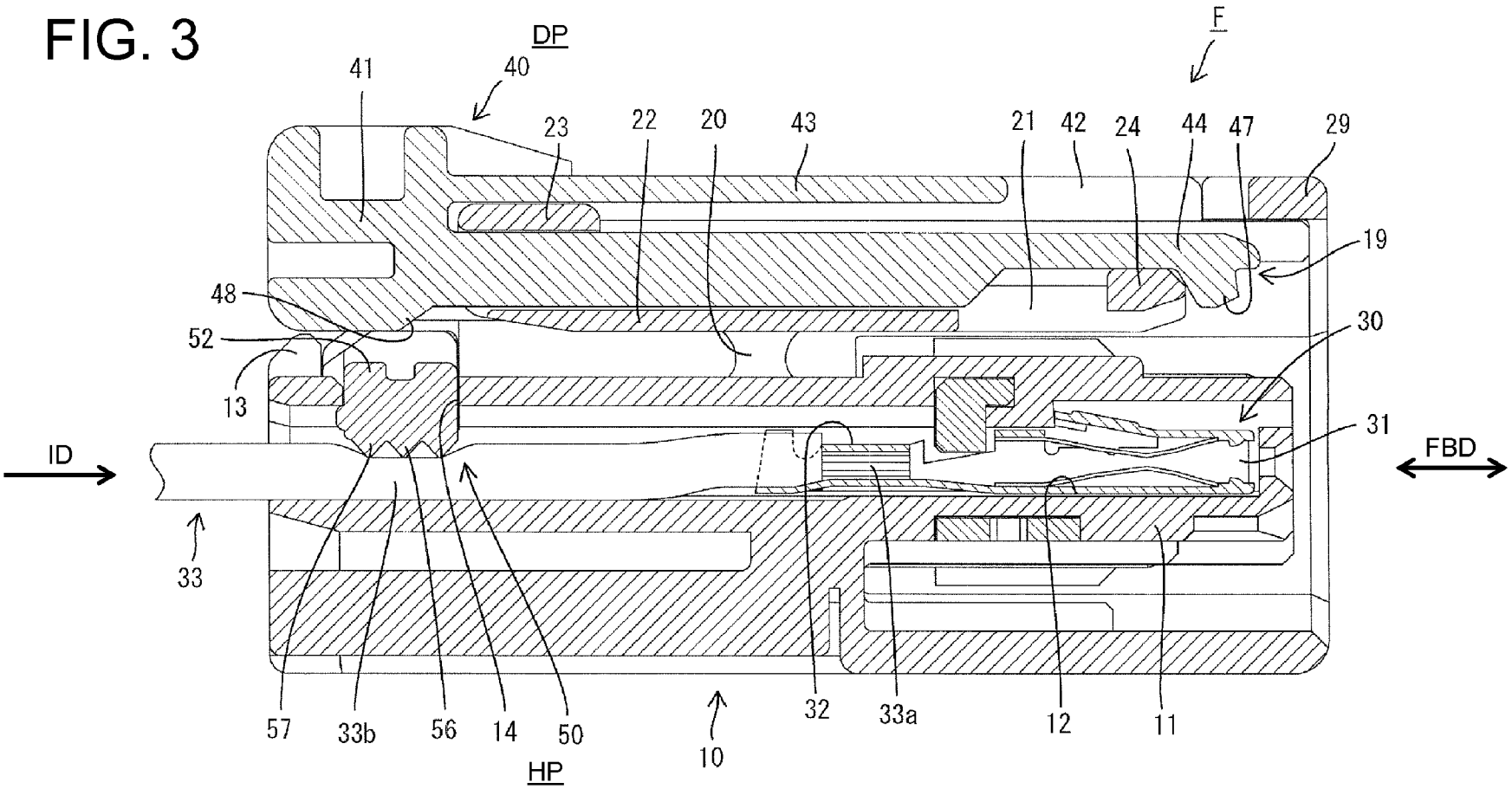
FIG. 3 is a longitudinal section showing a state attained by moving a mounted-state detecting member to a detection position in the state of FIG. 2.
Figure 4:
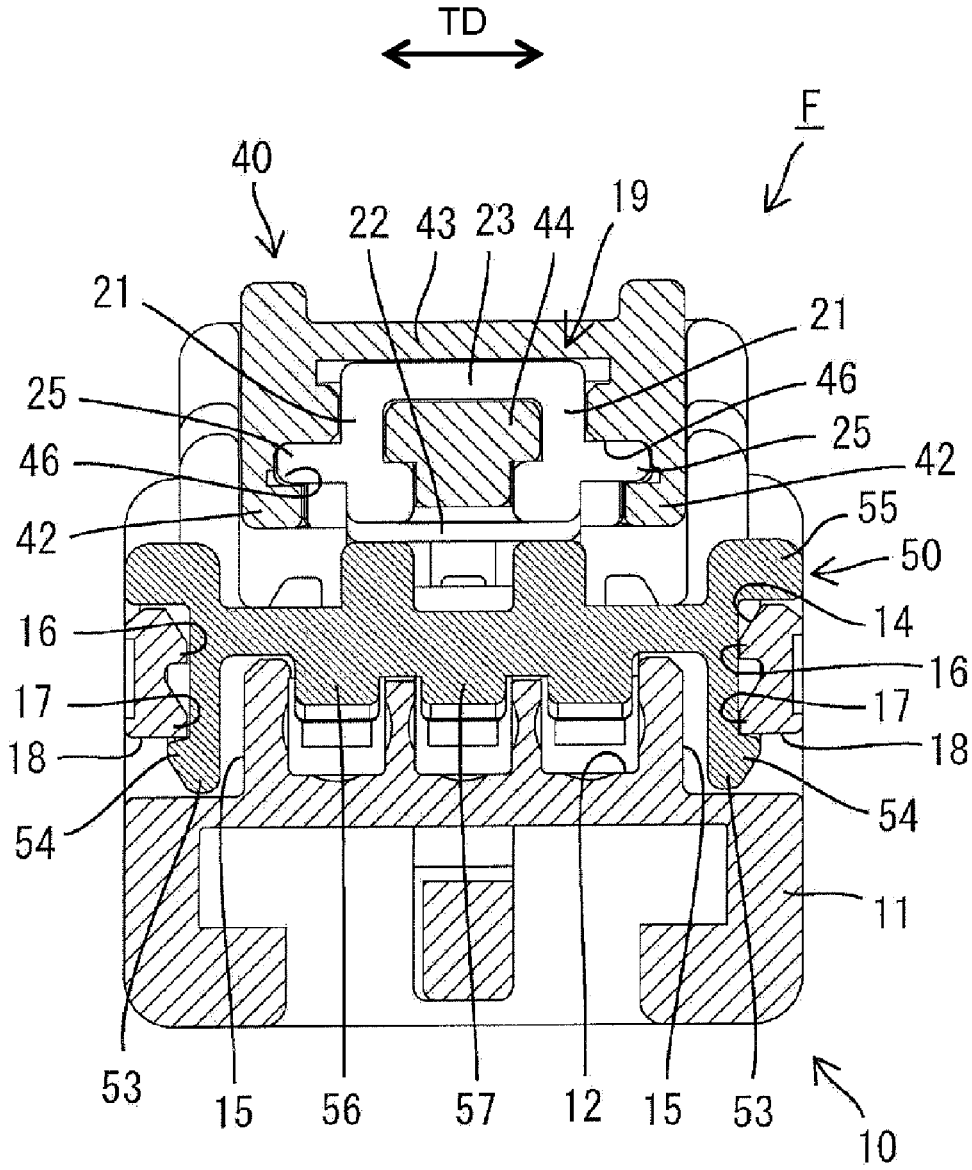
FIG. 4 is a lateral section.
Figure 5:
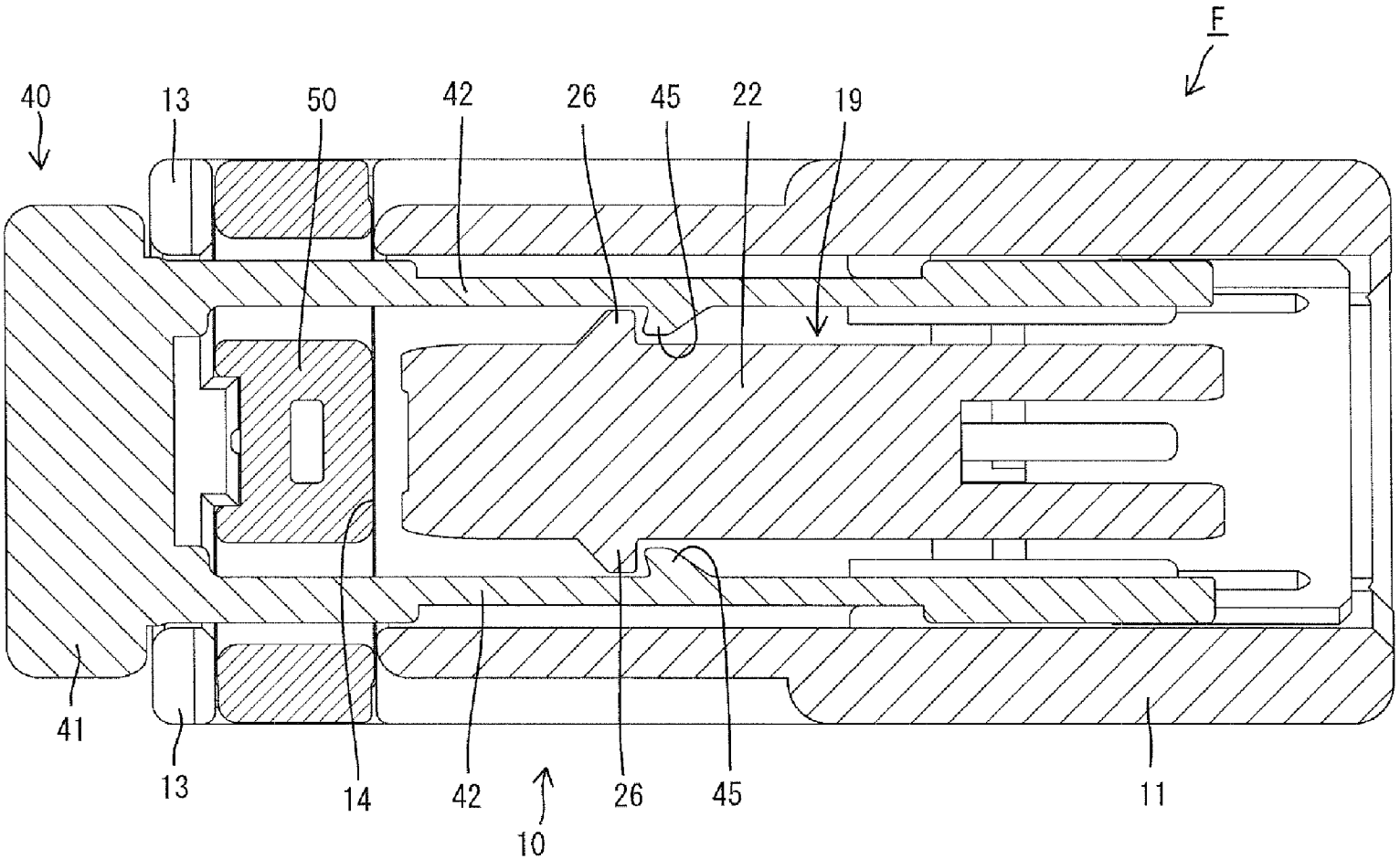
FIG. 5 is a horizontal section.
Figure 6:
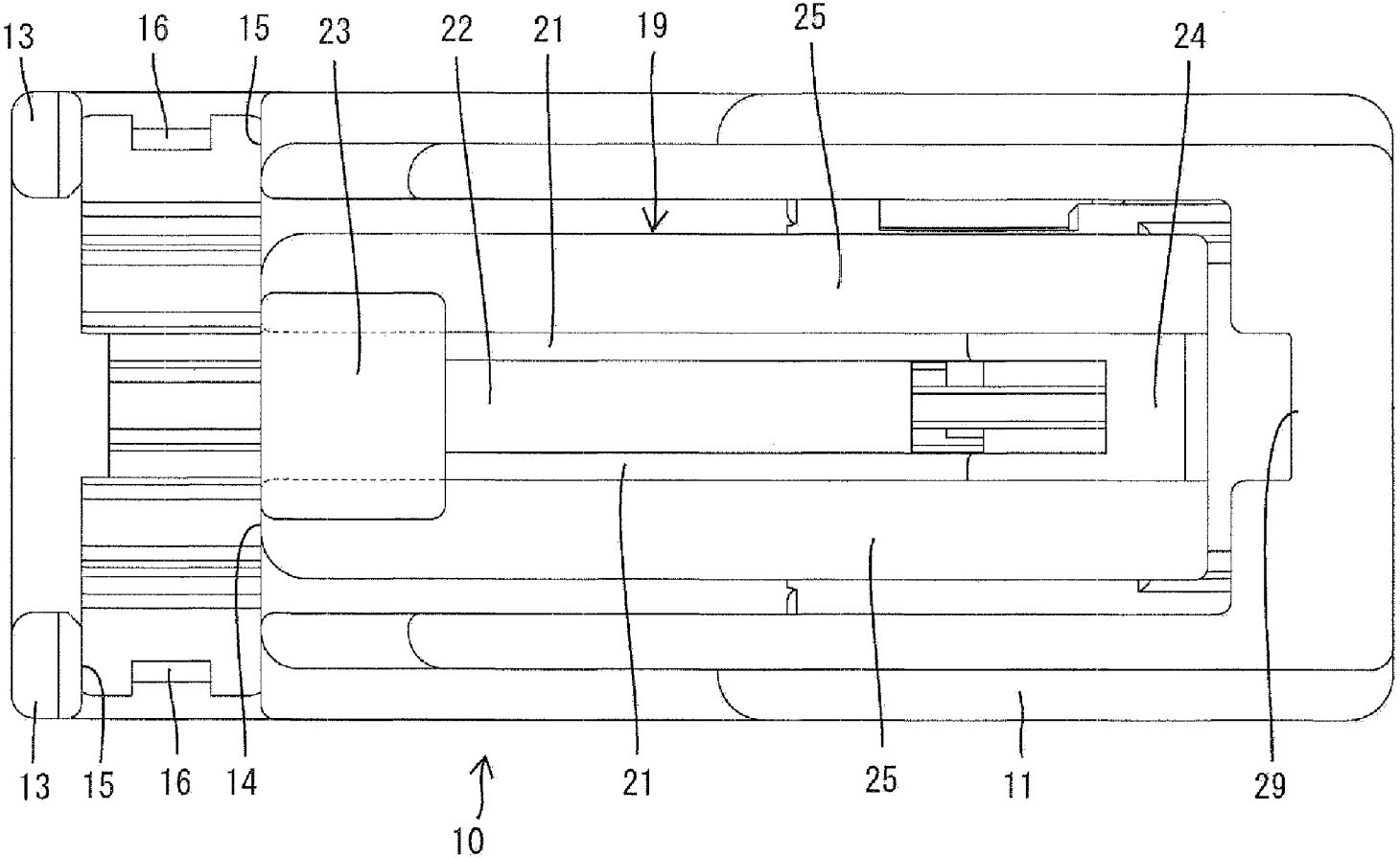
FIG. 6 is a plan view of a housing.
Figure 7:
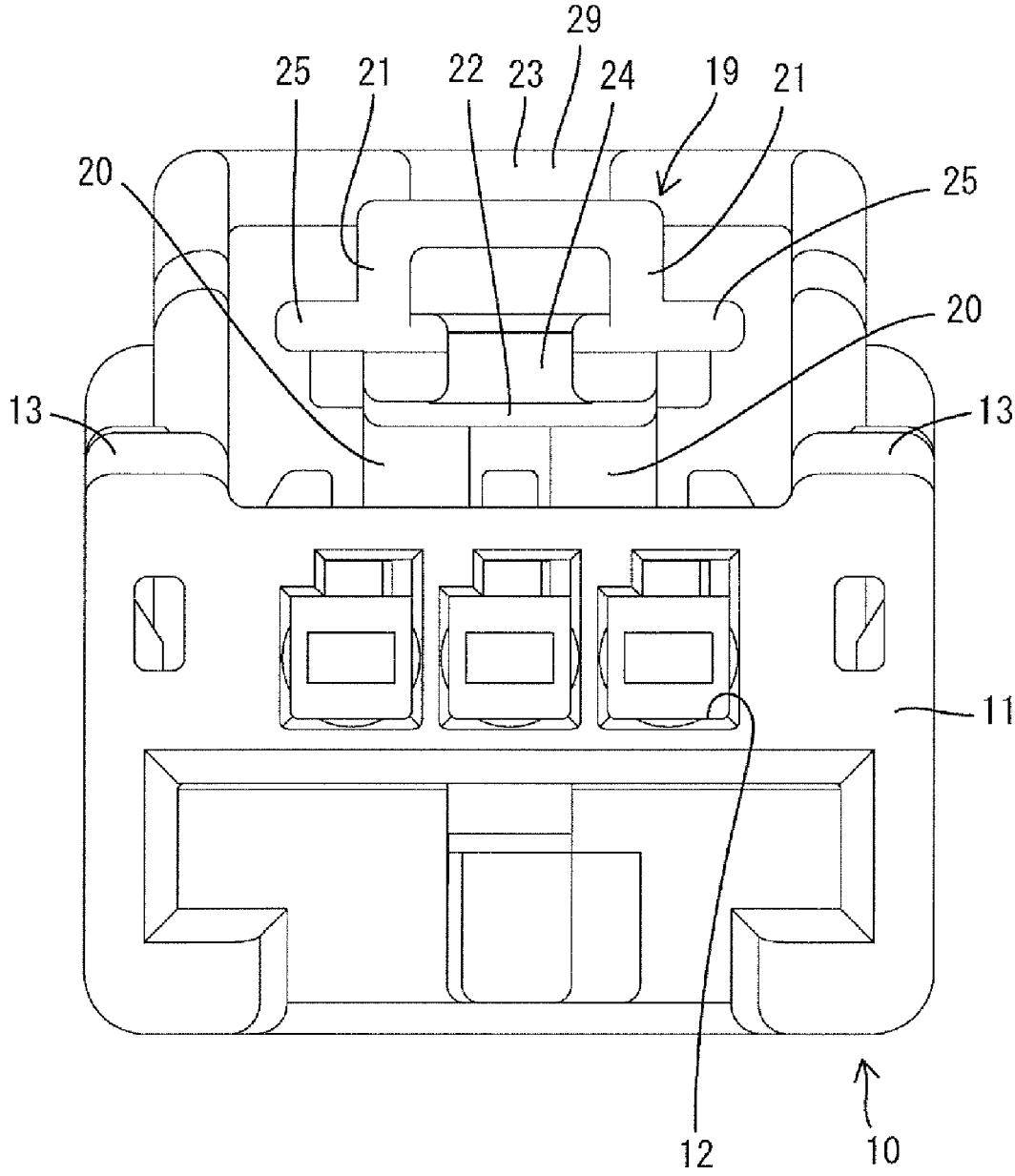
FIG. 7 is a rear view of the housing
Figure 8:
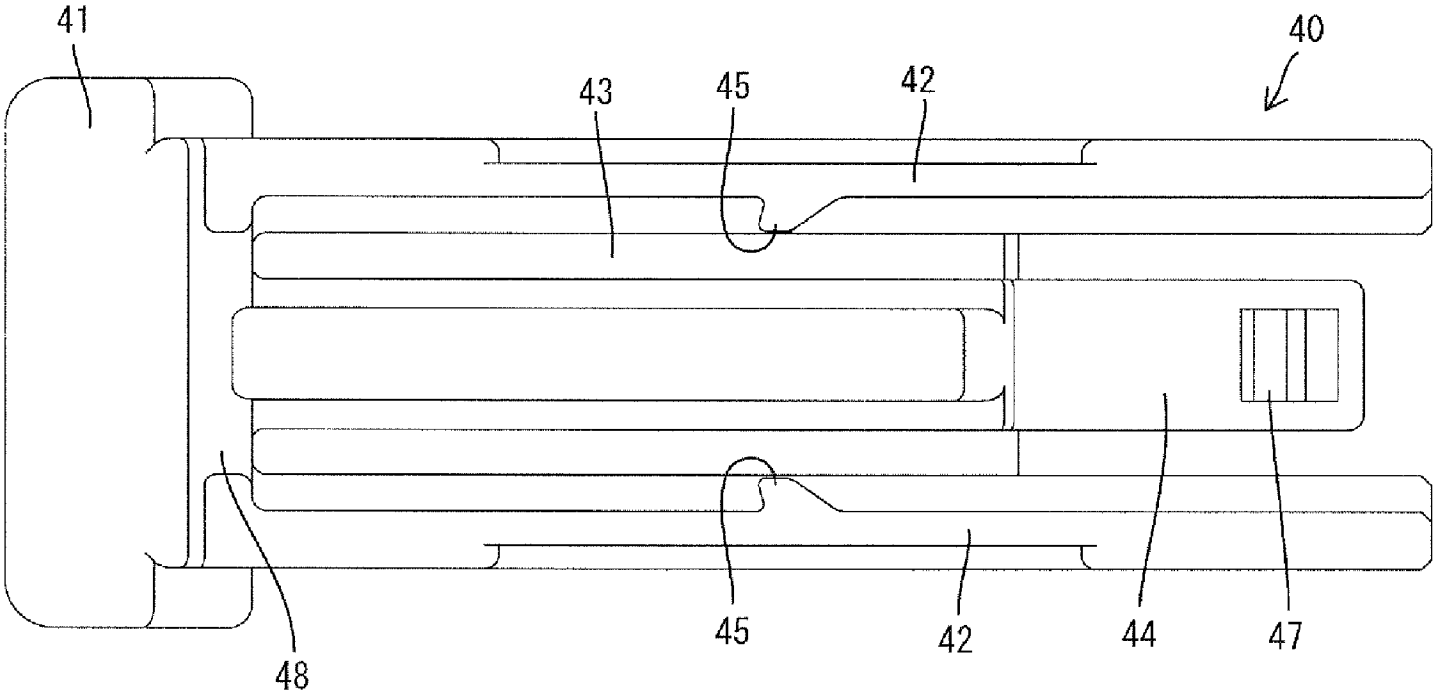
FIG. 8 is a plan view of the mounted-state detecting member
Figure 9:
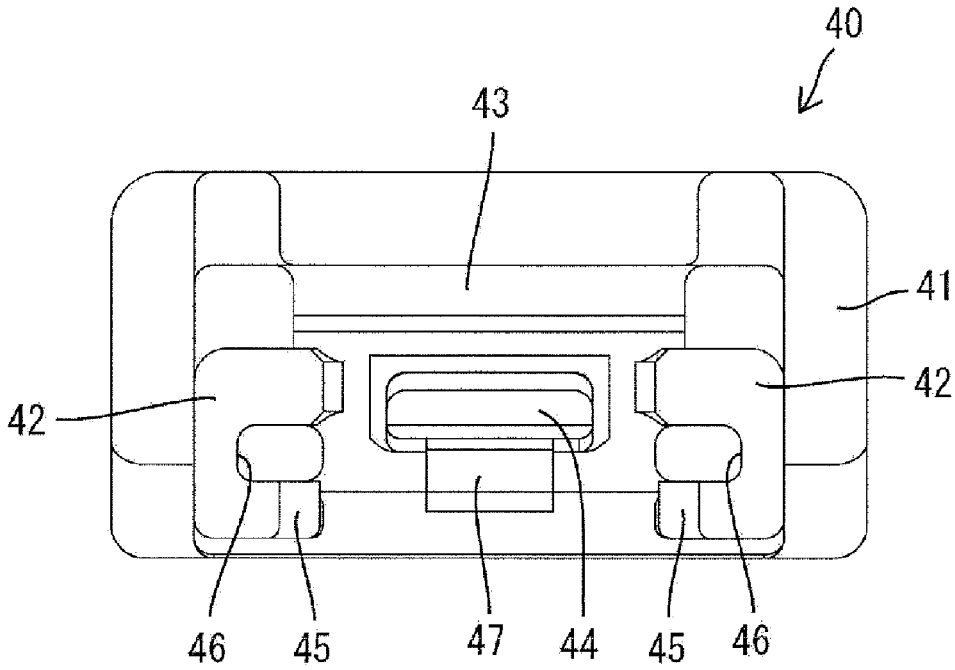
FIG. 9 is a front view of the mounted-state detecting member.
Figure 10:
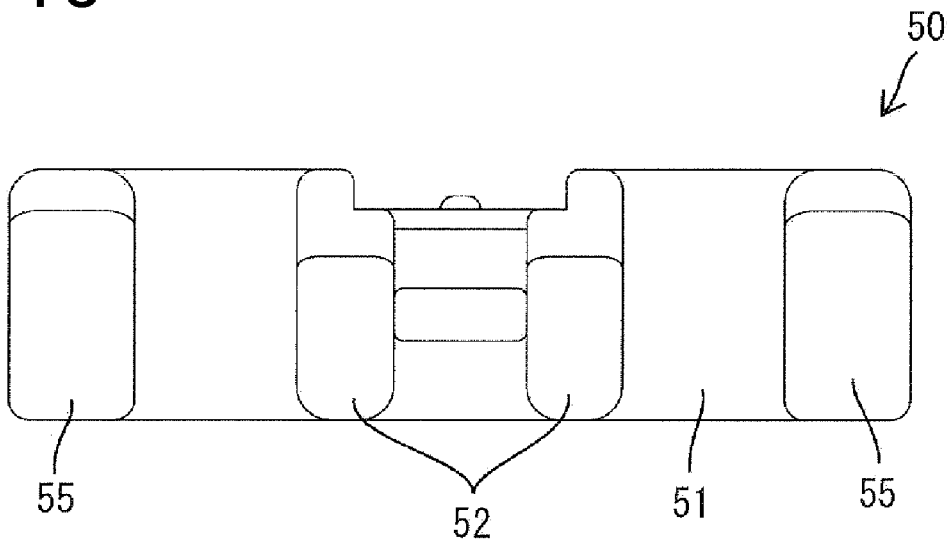
FIG. 10 is a plan view of the wire holding member
Figure 11:
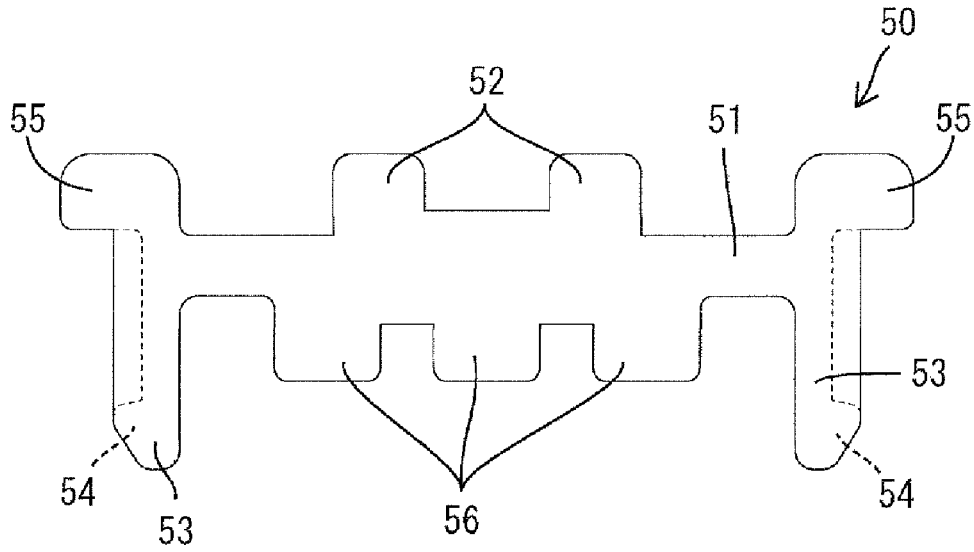
FIG. 11 is a front view of the wire holding member.
Figure 12:
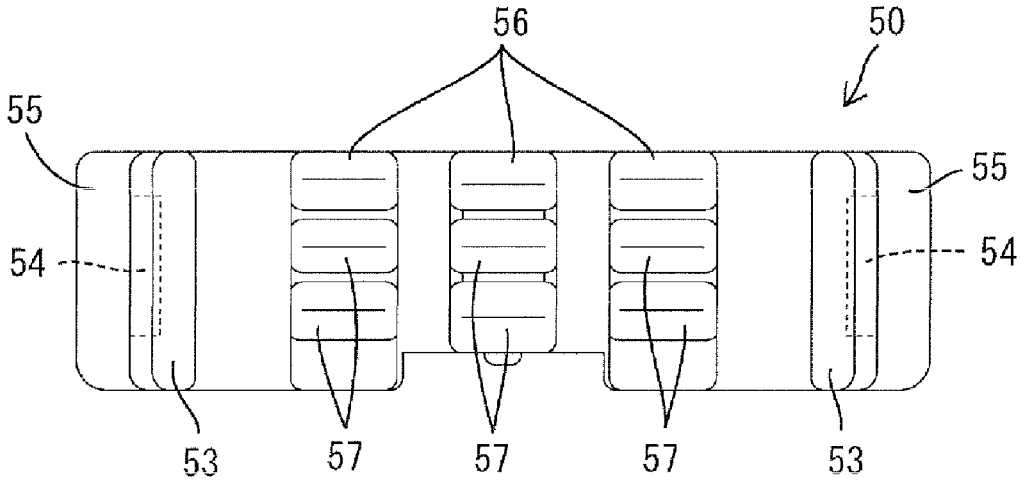
FIG. 12 is a bottom view of the wire holding member.
Figure 13:
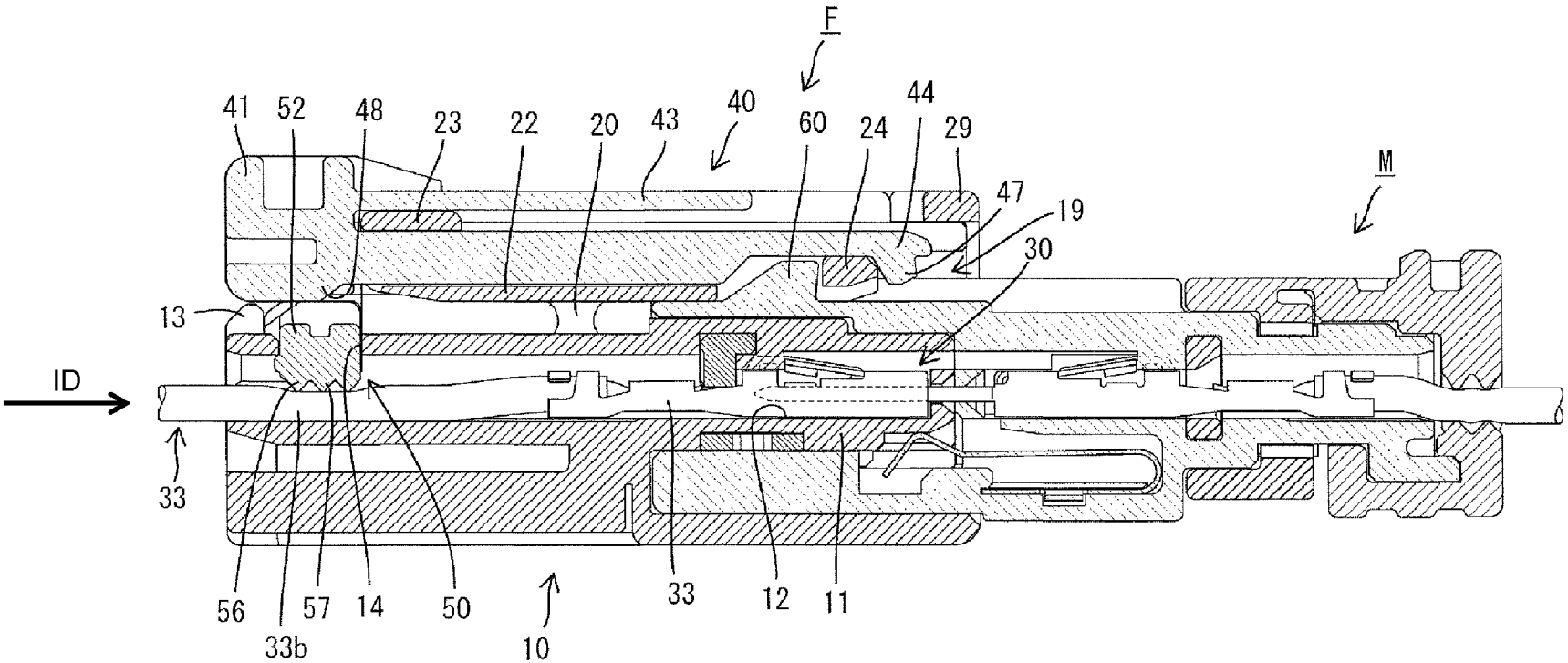
FIG. 13 is a longitudinal section showing a connected state with a mating connector.

A female connector in accordance with the invention is identified by the letter F in FIGS. 1 to 13. The connector F has a housing 10 made e.g. of synthetic resin. Female terminal fittings 30 are mounted in the housing 10. The connector F also has a mounted-state detector 40 made e.g. of synthetic resin, and a wire holder 50 made e.g. of synthetic resin. The housing 10 includes a flat block-shaped terminal accommodating portion 11 and a lock arm 19 is formed on the upper surface of the terminal accommodating portion 11. Long narrow cavities 12 extend in forward and backward directions FBD in the terminal accommodating portion 11 and are arranged substantially side by side in a transverse direction TD of the terminal accommodating portion 11. The female terminal fittings 30 are inserted into the respective cavities 12 from behind and along an insertion direction ID. The upper walls of the cavities 12 also define the upper wall of the terminal accommodating portion 11. Left and right receiving portions 13 for detection project obliquely up and out towards the front from the rear end of the upper surface of the terminal accommodating portion 11.

A substantially rectangular communication space 14 penetrates a rear end of the upper wall of the terminal accommodating portion 11 and communicates with the cavities 12. The communication space 14 is arranged before and adjacent to the receiving portions 13. Left and right guide holes 15 extend down substantially normal to the insertion direction ID from the opposite left and right ends of the communication space 14 along the opposite left and right walls of the terminal accommodating portion 11 near the rear end of the terminal accommodating portion 11. The cavities 12 are located between the guide holes 15. A partial locking projection 16 projects from the side wall of the terminal accommodating portion 11 in each guide hole 15 and a full locking projection 17 is located below the partial locking projection 16. Windows 18 are formed at the rear end of the terminal accommodating portion 11 and extend from the bottom ends of the respective guide holes 15 to the outer surfaces of the side walls.

The lock arm 19 includes a leg 20 that projects up from the upper wall of the terminal accommodating portion 11. Left and right arms 21 extend in forward and backward directions FBD from the upper end of the leg 20. A lower plate 22 connects the bottom end edges of the arms 21, an upper plate 23 connects the upper end edges of the arms 21 and a lock 24 connects the front ends of the arms 21. A formation area of the lower plate 22 in forward and backward directions FBD extends from a position behind the lock 24 to the rear ends of the arms 21, and the upper plate 23 is arranged at the rear ends of the arms 21. Guide ribs 25 are formed on the outer side surfaces of the arms 21 and extend in forward and backward directions FBD parallel to the length direction of the lock arm 19 in a free state and along a connecting direction with a male connector M. Retaining projections 26 are formed on the outer side surfaces of the arms 21. The lock arm 19 is resiliently displaceable up and down like a seesaw with the leg 20 as a support.

Each female terminal fitting 30 is long and narrow in forward and backward directions FBD. A box-shaped tubular connecting portion 31 is formed at the front of each female terminal fitting 30 and a wire crimping portion 32 is formed at the rear. The female terminal fitting 30 is used with a known wire 33 of substantially circular cross section with a conductor 33*a* and an insulation coating 33*b*. A front end of the wire 33 is connected electrically with the wire crimping portion 32. The female terminal fitting 30 is inserted into the cavity 12 from behind and along the inserting direction ID so that the wire 33 extends back substantially along the inserting direction ID from the female terminal fitting 30. The properly inserted female terminal fitting 30 is held in the cavity 12 by a lock and the wire 33 is arranged substantially straight to pass the communication space 14 at the rear end of the cavity 12.

The mounted-state detector 40 includes a substantially block-shaped operable portion 41 and two guide arms 42 are cantilevered forward from the operable portion 41. A plate-like connecting portion 43 is provided on the upper end edges of the guide arms 42, and a resilient locking piece 44 is cantilevered forward from the operable portion 41 in a space adjacent to and between guide arms 42. A retaining projection 45 and a guide groove 46 are formed on the inner side surface of each of the guide arm 42 and extend in forward and backward directions FBD. The resilient locking piece 44 is resiliently deformable up and down towards and away from the housing 10 in a direction intersecting the connecting direction, and a contact projection 47 projects in and down towards the housing 10 from the front end of the resilient locking piece 44. The bottom end of the operable portion 41 projects down slightly more than the lower surface of the resilient locking piece 44, and the front end edge thereof doubles as a connection detecting portion 48. The lower or inner surface of the rear end of the resilient locking piece 44 forms part of the cover similar to the operable portion 41.

The mounted-state detector 40 is assembled with the lock arm 19 from behind and along an assembling direction AD. The guide ribs 25 and the guide grooves 46 engage in the assembling process. The mounted-state detector 40 then is slid forward with respect to the lock arm 19 and the guide arms 42 are deformed out due to interference of the retaining projections 26, 45. When the mounted-state detector 40 is mounted at a standby position with respect to the lock arm 19, the retaining projections 45 of the mounted-state detector 40 engage the retaining projections 26 of the lock arm 19 from the front to prevent the mounted-state detector 40 from coming out backward, and the contact projection 47 engages the lock 24 from behind to stop the mounted-state detector 40 at its limit front-limit position. The mounted-state detector 40 is held at the standby position by these engaging actions. In this state, the operable portion 41 projects back from the rear end surface of the housing 10 and the connection detector 48 is located substantially right above the receiving portions 13. The resilient locking piece 44 is located between the upper plate 23 and the lower plate 22 and between the left and right arms 21. Thus, the mounted-state detector 40 is displaced like a seesaw together with the lock arm 19. If the operable portion 41 is pushed down, the lock arm 19 and the mounted-state detector 40 can be resiliently displaced to unlocking postures.

The wire holder 50 includes a transversely long main body 51, and left and right operable portions 52 project from the upper surface of the main body 51. Two substantially plate-like locking arms 53 extend down substantially normal to the main body 51 from left and right end edges of the main body 51. Shallow recesses are formed in the outer side surfaces of the locking arms 53, and locking projections 54 are formed on the bottom ends of the locking arms 53 by the recesses. Stoppers 55 project laterally out at the left and right end edges of the main body 51. Three pressing portions 56 are formed on the lower surface of the main body 51. The pressing portions 56 project substantially side by side in the transverse direction TD and correspond individually to the cavities 12. Each pressing portion 56 is long in forward and backward directions FBD and biting projections that are pointed or triangular in side view are arranged one after another in forward and backward directions FBD on the lower surface.

The wire holder 50 is mounted into the communication space 14 of the terminal accommodating portion 11 before the mounted-state detector 40 is assembled with the lock arm 19. Upon being mounted, the wire holder 50 is inserted into the communication space 14 from above and along a direction intersecting the inserting direction ID. In this process, the locking arms 53 are deformed resiliently inwardly in the guide holes 15 due to interference of the locking projections 54 and the partial locking projections 16. However, after sufficient insertion, the locking projections 54 pass the partial locking projections 16, and are held between the partial locking projections 16 and the full locking projections 17 for positioning the wire holder 50 at a release position RP. In this state, the pressing portions 56 are retracted up from entrance paths in the cavities 12 for the female terminal fittings 30 and the wires 33. Further, the upper end surfaces of the pressable portions 52 face the lower surface of the rear end of the resilient locking piece 44 of the mounted-state detector 40, and are above the upper ends of the receiving portions 13. The stoppers 55 are located laterally out of the mounted-state detector 40 and the lock arm 19. Thus, the upper surfaces of the stoppers 55 are exposed without being covered.

The stoppers 55 can be pushed down in a displacement direction DD and substantially normal to the inserting direction ID to displace the wire holder 50 farther into the terminal accommodating portion 11 and into a hold position HP more inward than the release position RP. In the displacing process, the locking arms 53 are deformed resiliently inward due to interference of the locking projections 54 and the full locking projections 17. The stoppers 55 contact the side walls of the terminal accommodating portion 11 when the wire holder 50 reaches the hold position HP, and the locking projections 54 engage with the full locking projections 17 from below. Thus, the wire holder 50 is locked at the hold position while vertical movements are prevented. In this state, the respective pressing portions 56 are located in the corresponding cavities 12 and the locking projections 54 are exposed at the outer side surfaces of the terminal accommodating portion 11 through the windows 18. Further, the upper end surfaces of the pressable portions 52 are lower than the upper ends of the receiving portions 13.

The wire holder 50 is held at the release position RP so that the female terminal fittings 30 can be mounted into the cavities 12 along the inserting direction ID. The wire holder 50 could be moved inadvertently in the displacement direction DD and to the hold position HP at this time. In this case, jigs (not shown) are inserted through the windows 18 to push the locking projections 54 and to deform the locking arms 53 inwardly. The stoppers 55 then are gripped to lift the wire holder 50 up to the release position.

The wire holder 50 is moved to the hold position HP by pressing the upper surfaces of the stoppers 55 after insertion of the female terminal fittings 30. Thus, the pressing portions 56 press the wires 33 against the bottoms of the cavities 12, and the biting projections 57 bite in or deform the insulation coating 33*b* of the wires 33 to prevent movements of the wires 33 in forward and backward directions FBD. The depth of bite of the biting projections 57 is set so as not to break the insulation coatings 33*b*. The downward facing edges of the biting projections 57 preferably are curved surfaces instead of being pointed.

The lock 24 moves onto a lock projection 60 of the male connector M in the process of connection. As a result, the lock arm 19 and the mounted-state detector 40 incline up and out towards the front and into unlocking postures so that the connection detecting portion 48 of the mounted-state detector 40 is displaced down in the displacement direction DD to face the receiving portions 13 of the housing 10 from behind. Accordingly, the connection detecting portion 48 will contact the receiving portions 13 from behind and prevent the mounted-state detector 40 from being moved forward to the detection position DP if the connecting operation of the two connectors F, M is finished halfway. Forward movement of the mounted-state detector 40 also is prevented by the contact of the contact projection 47 with the lock 24.

The lock 24 passes the lock projection 60 when the two connectors F, M are connected properly. Therefore the lock arm 19 is restored towards its free state by its resilient restoring force so that the lock 24 engages the lock projection 60 to lock the connectors F, M together. Further, the lower surface of the contact projection 47 contacts the upper surface of the lock projection 60 as the lock arm 19 is restored resiliently towards the free state. Thus, the resilient locking piece 44 is deformed up and out relative to the lock arm 19, with the result that the contact projection 47 disengages from the lock 24 and the forward movement restricted state of the mounted-state detector 40 is canceled by the engaging action of the contact projection 47 and the lock projection 24. The operable portion 41 of the mounted-state detector 40 returns to an upper position together with the lock arm 19. Thus, the connection detecting portion 48 assumes a position higher than the receiving portions 13 so that the forward movement restricted state of the mounted-state detector 40 also is canceled. Thereafter, the mounted-state detector 40 can be slid forward to the detection position DP after the two connectors F, M are connected properly. In the course of moving the mounted-state detector 40 to the detection position DP, the contact projection 47 passes the lock 24. Thus, the resilient locking piece 44 is restored resiliently to engage the contact projection 47 with the lock projection 24 from the front. Accordingly, the mounted-state detector 40 is held at the detection position DP while having a backward movement prevented.

The front ends of the arms 21 engage with a restriction 29 along the upper edge of the front end of the housing 10 when the mounted-state detector 40 is at the detection position DP. Thus, displacement of the lock arm 19 in an unlocking direction is prevented, and the lock 24 cannot disengage from the lock projection 60. In this way, a double locking state is set where the lock 24 and the lock projection 60 reliably are held engaged and the two connectors F, M are locked reliably together.

The connection detecting portion 48 interferes with the pressable portions 52 of the wire holder 50 in the process of moving the mounted-state detector 40 to the detection position DP and prevents any further forward movement of the mounted-state detector 40 if the wire holder 50 is not at the hold position HP in the properly connected state of the two connectors F, M. Accordingly, the mounted state of the wire holder 50 can be detected based on whether the mounted-state detector 40 is prevented from moving forward by the interference with the wire holder 50.

The wire holder 50 is mounted from above in a direction DD intersecting the inserting direction ID of the female terminal fittings 30 and engages the insulation coatings 33*b* of the wires 33 to provide strain relief and to prevent forward and backward movements of the wires 33. Accordingly, as compared to a strain relief structure for preventing movements of the wires by bending the wires, a layout space for the wires 33 can be smaller and the female connector F can be miniaturized.

The wire holder 50 can be locked selectively in the housing 10 at the release position RP where the wire holder 50 is separated from the wires 33 and the hold position HP where the wire holder 50 prevents movements of the wires. Thus, the wire holder 50 can be mounted in the housing 10 before inserting the female terminal fittings 30 into the housing 10 and, hence, operability is good.

The mounted-state detector 40 for detecting the mounted state of the wire holder 50 also functions as connection detecting means for detecting the connected state of the two connectors F, M. Thus, the number of parts can be reduced as compared to the case where special connection detecting means is provided in addition to the mounted-state detector 40.

The rear end of the resilient locking piece 44 of the mounted-state detector 40 and the operable portion 41 thereof are arranged to cover a part of the wire holder 50 except the opposite lateral edges (stoppers 55) from the upper side. Thus, external matter is unlikely to interfere with the wire holder 50.

The invention is not limited to the above described and illustrated embodiment. For example, the following embodiments are also embraced by the technical scope of the present invention as defined by the claims.

The wire holder may not be locked at the release position.

The mounted-state detector may not include the connection detecting means.

The wires and the terminal fittings may be connected by insulation displacement, soldering and/or welding instead of being connected by crimping.

The outer surface of the wire holder may be exposed without being covered by the mounted-state detector.

What is claimed is:

1. A connector, comprising:

at least one terminal fitting having a backward extending wire fixed to a rear end portion thereof;

a housing into which the terminal fitting is inserted in an insertion direction (ID);

at least one wire holder to be mounted and displaced into the housing in a direction intersecting the inserting direction of the terminal fitting, the wire holder being selectively lockable in the housing at a release position where the wire holder is spaced from the wire and at a hold position where the wire holder bites in an insulation coating of the wire for holding the wire and substantially preventing movements of the wire; and a mounted-state detecting means for detecting a mounted state of the wire holder and for detecting whether the connector is connected properly with a mating connector.

2. A connector, comprising:

at least one terminal fitting having a backward extending wire fixed to a rear end portion thereof;

a housing, into which the terminal fitting is inserted in an insertion direction;

at least one wire holder to be mounted and displaced into the housing in a direction intersecting the inserting direction of the terminal fitting, the wire holder being configured to bite in an insulation coating of the wire in a mounted state in the housing for holding the wire and substantially preventing movements of the wire; and a mounted-state detector formed separate from the wire holder and movable with respect to the housing, the mounted-state detector having an interfering portion that interferes with the wire holder when the wire holder is at a release position to prevent a movement of the mounted-state detector to a detection position, and the interfering portion permitting movement of the mounted-state detector to the detection position when the wire holder is at a hold position, the mounted-state detector includes a connection detector for permitting the mounted-state detector to move to the detection position when the connector is connected properly with the mating connector while preventing movement of the mounted-state detector to the detection position if the connector is connected improperly with the mating connector.

3. The connector of claim 2, wherein the mounted-state detector is formed with at least one cover for at least partly covering the wire holder from an outer side.

4. The connector of claim 2, wherein the wire holder has at least one pressable portion configured for contacting the mounted-state detector when the mounted-state detector is moved to the detecting position.

5. A connector, comprising:

at least one terminal fitting having a backward extending wire fixed to a rear end portion thereof;

a housing having opposite front and rear ends and at least one cavity extending between the front and rear end for receiving the terminal fitting in an inserting direction, a communication space formed in the housing at a location spaced from the front and rear ends, the communication space communicating with the cavity;

at least one wire holder to be mounted and displaced into the communication space of the housing in a direction intersecting the inserting direction of the terminal fitting, the wire holder being configured to bite in an insulation coating of the wire in a mounted state in the housing for holding the wire and substantially preventing movements of the wire; and a mounted-state detector engaged with the housing at a position spaced from the wire and the terminal fitting, the mounted-state detector being movable relative to the housing substantially parallel to the inserting direction for detecting a mounted state of the wire holder and for detecting whether the connector is connected properly with a mating connector.

* * * * *